US012729506B2

(12) United States Patent
Sharp et al.

(10) Patent No.: US 12,729,506 B2
(45) Date of Patent: Sep. 8, 2026

(54) IN AND RELATING TO THE WORKING OF GROUND AND OTHER SURFACES

(71) Applicant: Progressive IP Limited, Te Rapa Hamilton (NZ)

(72) Inventors: Rodney Warwick Sharp, Ngaruawahia (NZ); Benjamin Sharp, Hamilton (NZ)

(73) Assignee: PROGRESSIVE IP LIMITED, Te Rapa Hamilton (NZ)

( * ) Notice: Subject to any disclaimer, the term of this patent is extended or adjusted under 35 U.S.C. 154(b) by 757 days.

(21) Appl. No.: 18/014,709

(22) PCT Filed: Jul. 6, 2021

(86) PCT No.: PCT/IB2021/056020
§ 371 (c)(1),
(2) Date: Jan. 5, 2023

(87) PCT Pub. No.: WO2022/009076
PCT Pub. Date: Jan. 13, 2022

(65) Prior Publication Data

US 2023/0287651 A1 Sep. 14, 2023

(30) Foreign Application Priority Data

Jul. 6, 2020 (NZ) ..... 766030

(51) Int. Cl.
*E02F 3/96* (2006.01)
*E02F 3/76* (2006.01)
(Continued)

(52) U.S. Cl.
CPC ..... *E02F 3/962* (2013.01); *E02F 3/7631* (2013.01); *E02F 3/8157* (2013.01); *E02F 3/844* (2013.01); *E02F 3/961* (2013.01)

(58) Field of Classification Search
None
See application file for complete search history.

(56) References Cited

U.S. PATENT DOCUMENTS 5,067,261 A * 11/1991 Betts ..... A01G 23/06 172/698
5,490,340 A * 2/1996 Muncy ..... A01B 13/00 172/698

(Continued)

FOREIGN PATENT DOCUMENTS

EP 3 623 532 3/2020
EP 3623532 A1 * 3/2020 ..... E02F 3/845
WO 2015/190937 12/2015

OTHER PUBLICATIONS

International Search Report for PCT/IB2021/056020 dated Oct. 13, 2021, 3 pages.

(Continued)

*Primary Examiner* — Christopher J Sebesta
*Assistant Examiner* — Alfred H Tsui
(74) *Attorney, Agent, or Firm* — NIXON & VANDERHYE

(57) ABSTRACT

Ground/face working apparatus (1) comprises a primary support portion (2) for mounting to a vehicle and an accessory body portion (3) including or allowing the attachment of an accessory such as a blade (5). Multiple fixed length links (4*a-c*) allow and limit a degree of relative movement between the accessory body portion (3) and primary support portion (2) including lateral, vertical, and roll rotational (about a horizontal longitudinal axis). Control actuators (6*a*, 6*b*) primarily control the aforesaid rotational and vertical dispositions of the portions (2, 3) while a side shift variable length link comprising an actuator (8) affects the amount of lateral movement.

9 Claims, 6 Drawing Sheets

(51) Int. Cl.
*E02F 3/815* (2006.01)
*E02F 3/84* (2006.01)

(56) References Cited

U.S. PATENT DOCUMENTS

| | | | | |
|---|---|---|---|---|
| 6,273,198 | B1 | 8/2001 | Bauer et al. | |
| 6,360,459 | B1 * | 3/2002 | Brookhart | E02F 3/345 37/234 |
| 9,648,796 | B1 * | 5/2017 | Tschetter | A01B 43/00 |
| 10,676,894 | B2 | 6/2020 | Sharp | |
| 2014/0250741 | A1 * | 9/2014 | Simmons | A01G 23/062 37/302 |
| 2020/0102717 | A1 * | 4/2020 | Sharp | E02F 3/8155 |
| 2020/0173141 | A1 * | 6/2020 | Gentle | E02F 3/765 |
| 2020/0181872 | A1 * | 6/2020 | Kumbhar | E02F 3/7627 |

OTHER PUBLICATIONS

Written Opinion of the ISA for PCT/IB2021/056020 dated Oct. 13, 2021, 5 pages.

* cited by examiner

IN AND RELATING TO THE WORKING OF GROUND AND OTHER SURFACES

This application is the U.S. national phase of International Application No. PCT/IB2021/056020 filed Jul. 6, 2021 which designated the U.S. and claims priority to NZ 766030 filed Jul. 6, 2020, the entire contents of each of which are hereby incorporated by reference.

FIELD OF INVENTION

The present invention is directed to ground and surface working apparatus, typically as used on tractors, excavators, and skid-steer vehicles, though also may be mounted to other types of vehicles. Preferred embodiments of the present invention have the ability to vary the relative lateral positioning of an accessory (or accessory support) relative to a primary support portion which may mount to a vehicle. The ability to raise and lower the accessory/support, and rotate about a longitudinal axis, are also options on variations of the invention.

BACKGROUND DESCRIPTION

The present invention derives from levellers, a device typically attached to tractors, excavators, and skid-steer vehicles for the purpose of levelling and smoothing the ground. The inventor has previously developed a ground levelling assembly disclosed in patent publications WO2015190937A1, and U.S. Pat. No. 10,676,894B2.

Over time demand for these types of devices have increased, along with what they are required to do. While the original levellers were designed predominantly for skid-steers and excavators, demand is for fitting to a greater range of land and off-land vehicles and vessels. There is also a developing need for providing improved designs for excavator mounting. Equipment mounted on the boomer/dipper arm combination of an excavator have a different range of movements (and movement restrictions) than most other vehicles. Accessories mounted to excavator arms often have an arcuate component to any movements, and additional movement/flexibility on mounted ground working assemblies is often required to realise the full potential of the equipment. Hence there is a need for improved designs which are suitable or can be adapted for excavator use.

Also more sophisticated accessory manipulations and control are increasingly required, as well as increased versatility. For instance, more advanced levelling/grading and contouring operations may be required rather than straight forward levelling. These heavier duty operations can increase stresses on equipment and certain points thereon. A greater range and repertoire of movements of an attached accessory are often desirable in certain situations and applications. Rather than just up and down elevational movements, roll-angular movement of an accessory is also virtually a requirement on modern equipment. And more recently the advantages of being able to laterally shift an accessory have come to light and has increased demands for equipment able to provide such movement.

Further complicating matters is a desire to use equipment on lighter duty vehicles, so there is also a need for flexible new designs which can provide a wide range of movements that the industry and market wants, but also are reliable in field for the majority of intended uses and applications that a user might put the equipment to and on the vehicles they have available. Many users have relatively light-weight skid steer loaders due to cost and manoeuvrability considerations. Newer more functional designs are of limited use if they are not suitable for these lighter weight vehicles. Similarly, for excavator mounting there are a number of considerations in which reduced weight is a distinct advantage.

The trend in practice is that vehicle mounted/attached ground working apparatus attempt more sophisticated operations, especially when used in combination with guidance systems (e.g. laser guidance and levelling systems etc.). At the time of the original inventor's work of the aforelisted publications, most demand was for accurate and quick levelling of large work and construction sites. Now the inventor has been presented with multiple requests from the industry for solutions which allow precision work—such as near existing features and objects. Examples include being able to work close to existing walls and foundations—often this cannot be done or only in one direction. This is typical due to overly wide ground working assemblies which are wider than the support vehicle being too heavy and placing too much stress of the equipment and vehicle (a wider accessory (e.g. blade) presents much higher forces which is a problem on smaller and lighter capacity vehicles). Hence a solution that addresses these issues while allowing an accessory to be positioned offset to the centreline (median/sagittal plane) of the vehicle would address a want in the industry.

Specific applications requested by the industry include the ability to level sidewalk foundations, often between already formed kerbing and building foundations. Wide accessory systems which extend wider than the wheels of the support vehicle may actually be too wide for many applications where a smaller more agile solution is required. Also, for arm mounted systems on excavators, sometimes it would be more useful to be able to adjust a mounted accessory sideways (something which excavator arms don't provide for) to avoid having to manoeuvre the excavator body in both longitudinal and transverse directions during operations. Lateral shift ability has potential advantage for both excavator and wheeled/tracked vehicle mounted equipment.

While the term ground working is used, this can include inclined and vertical faces. It is also envisaged that variations of the present invention may need to be used on steeply inclined and vertical faces—such as in mining, tunnelling, and road cuttings type operations. However for simplicity of description most applications shall refer to horizontal operation with the ground plane as the workface.

Accordingly there is a need in the industry for accessory mounting equipment which are more flexible, and/or lighter, and/or versatile than the original leveller of the inventor such as outlined in the aforesaid patent publications. There is also a need in the industry for accessory mounting equipment capable of lateral shifting of a mounted accessory relative to the supporting vehicle.

It would therefore be desirable and useful to provide a potential solution allowing accessory assemblies to address one or more of the aforesaid needs and wants.

It is an object of the present invention to address at least some of the above problems.

At the very least it is an object of the present invention to provide the public with a useful alternative choice.

Aspects of the present invention will be described by way of example only and with reference to the ensuing description.

GENERAL DESCRIPTION OF THE INVENTION

According to one aspect of the present invention there is provided aground/face working assembly comprising a primary support portion and an accessory body portion;

said primary support portion and accessory body portion being connected by an interconnecting linkage set, said linkage set comprising at least three links connected at each end to said primary support portion and accessory body portion by joints accommodating angular movement, said accessory body portion either or both including or allowing for attachment of an accessory thereto;

there being included an operational control linkage set for affecting the relative positional disposition between said primary support portion and said accessory body portion, there also being a lateral linkage set comprising at least one link connected either or both directly or indirectly to said primary support and accessory body portions.

According to another aspect of the present invention there is provided a ground/face working assembly, substantially as described above, in which said links of the interconnecting linkage set are disposed to be substantially parallel to each other.

According to another aspect of the present invention there is provided a ground/face working assembly, substantially as described above, in which there are three links in the interconnecting linkage set.

According to another aspect of the present invention there is provided a ground/face working assembly, substantially as described above, in which, when viewed from the front of the apparatus, the three links are disposed in an isosceles or equilateral triangle arrangement.

According to another aspect of the present invention there is provided a ground/face working assembly, substantially as described above, in which two of said three links are connected at or near the base of said accessory body portion.

According to another aspect of the present invention there is provided a ground/face working assembly, substantially as described above, in which the connections of said links of the interconnecting linkage set comprise pivotable joints.

According to another aspect of the present invention there is provided a ground/face working assembly, substantially as described above, in which said pivotable joints comprise ball joints with a degree of angular movement of substantially 6° or more.

According to another aspect of the present invention there is provided a ground/face working assembly, substantially as described above, in which said operational control linkage set comprises at least one variable (during operation) length link disposed in either an inclined or substantially vertical manner.

According to another aspect of the present invention there is provided a ground/face working assembly, substantially as described above, in which a variable length link comprises an actuator, and there is at least one positioned either side of the sagittal centre line of said ground/face working assembly.

According to another aspect of the present invention there is provided a ground/face working assembly, substantially as described above, in which each variable length link is attached at each end to the primary support portion and accessory body portion, at least one such attachment comprising a pivotable joint.

According to another aspect of the present invention there is provided a ground/face working assembly, substantially as described above, in which a said pivotable joint comprises a ball joint with a degree of angular movement of substantially 6° or more.

According to another aspect of the present invention there is provided a ground/face working assembly, substantially as described above, in which the lateral linkage set comprises at least one variable (during operation) length link acting between the primary support portion and the accessory body portion.

According to another aspect of the present invention there is provided a ground/face working assembly, substantially as described above, in which a said variable length link is an actuator and is connected at each end by any one of: a bush, a ball joint, a pivotable joint with a degree of angular freedom of at least 6°.

According to another aspect of the present invention there is provided a ground/face working assembly, substantially as described above, wherein a said variable length link is oriented, when viewed from above, either substantially parallel to the transverse axis of the ground/face working assembly or an angle acute thereto.

According to another aspect of the present invention there is provided a ground/face working assembly, substantially as described above, in which there is present a yaw controllable linkage set acting to vary the yaw angle of the primary support portion and accessory body portion, said yaw angle being rotation about a substantially vertical axis.

According to another aspect of the present invention there is provided a ground/face working assembly, substantially as described above, in which said yaw controllable linkage set comprises one or more actuators.

According to another aspect of the present invention there is provided a ground/face working assembly, substantially as described above, in which actuators are hydraulic in operation.

According to another aspect of the present invention there is provided a ground/face working assembly, substantially as described above, in which there is present a control system for operational control of any variable (during operation) length links and actuators.

According to another aspect of the present invention there is provided a ground/face working assembly, substantially as described above, which includes at least one mounting means for attachment to the arm of an excavator, or to a complementary mount on a vehicle.

According to a further aspect of the present invention there is provided a ground/face working assembly, substantially as described above, mounted or attached to a vehicle or attachment point thereon.

Typically the present invention comprises a ground/face working assembly comprises a primary support portion and an accessory body portion. The primary support portion is the portion associated with the driving vehicle and typically comprises some type of mounting system thereto—such as, but not restricted to, a quick hitch mount arrangement as commonly used in the industry. The primary support portion may be constructed in different ways, though will often be influenced by the need to mount necessary linkages, and to withstand loads transmitted from the accessory body portion—possibly transmitting some of these forces back to the associated vehicle.

The accessory body portion is the portion where an accessory (or accessories) is/are present. The accessories may be integrally formed with the accessory body portion and/or mounted thereto. It is considered that this choice is largely one of user choice and may be influenced by a particular application or nature of the accessory etc. In the present invention being discussed, and for simplicity of description, we shall use the example where the accessory is a blade such as used for grading or levelling. There may optionally be a second blade for levelling/grading operations in the reverse direction. Other accessories that may be employed include rakes, rotary brushes, etc.

Connecting the accessory body portion and a primary support portion is at least an interconnecting linkage set. Typically there are at least three such links, some embodiments employ four, and more are possible. Other links (such as actuators for instance) may be present also but these will be discussed later.

The links of the interconnecting linkage set are typically fixed in length (as opposed to variable length) during operation. Simple and preferred embodiments of the invention use fixed length links, though adjustable length fixed (during operation) links may be employed. Variable length linkages can be employed though these can introduce other considerations such as cost, maximum load restrictions, resulting geometry changes affecting operation and potentially causing unwanted stress in various components. While it is possible to use variable (during operation) length links the additional considerations often make this option impractical for typical operations. However, as a variation, substituting a portion of the fixed links with variable links—such as the top link in a three link system such as illustrated later—could provide an option of adjusting the forward/rearward pitch of an accessory though consideration to other controlling actuators would need to be given.

The minimum number of links in the interconnecting linkage set is typically three. There are a number of reasons influencing why this should be so. For instance, the links of the interconnecting linkage set typically transmit loads back to the primary support portion. Three or more links are better able to do this.

Secondly, the links of the interconnecting linkage set are typically there to help maintain the relative disposition of the accessory body portion relative to the primary support portion, and restrict the relative orientations/geometry to within certain bounds. Take for instance an embodiment a three link arrangement with a triangular (preferably isosceles) mounting arrangement when viewed when looking at the invention from the front (toward an imaginary vehicle it is mounted to)—such as in FIG. 1 later herein. The resulting range of relative movement of the accessory body portion relation to the primary support portion is typically up/down, left/right, and rotation about a longitudinal axis of the invention. In a four link arrangement, in a rectangle, rhombus, or parallelogram when viewed from the front and such as shown in FIG. 7, the same range of movements are generally possible—providing everything is in alignment; misalignment or changing from a to rectangular/rhombus/parallelogram can limit certain movements, which can be used to advantage by the constructor of the invention if they which to impose some limitations.

More links in the interconnecting linkage set tend to be increasingly disadvantageous as the relative geometrical freedom of movement of the accessory body portion to the primary support portion becomes increasingly limited, if not stifled altogether. However mention will be made later to the lateral linkage between the accessory body and primary support portions—though this is considered separate to the interconnecting linkage set and outside the considerations discussed above.

Considering primarily the three and four link embodiments of the invention, both have some attributes. Four links can better accommodate loads than three in theory though in practice, engineering analysis indicates three are adequate for typical applications (preferred embodiments use 80 kN rated links which provide sufficient leeway above typically expected loads in levelling and grading applications).

A potential downside of using four links is that fabrication and alignment tolerances are tighter and may require more expensive fabrication techniques rather than assembly by off-the shelf components. A good example is if you take a three legged stool and a four legged table and place them on an uneven floor. The stool will always find a stable position with the three legs each contacting the floor. However, the four legged table can't and will rock. Now consider the floor to be the primary support portion and the table top the accessory body portion. Further consider that the legs are fixed links such that all four legs must contact the floor. The only way this can happen is by flexing of the table top (or floor) as the length of the legs is fixed. As the accessory body portion (table top) is typically rigid like a table top then we get stresses at various points in the system with likely future failure through repetition. The solution is attention to manufacturing tolerances and geometries, which are much higher than the three link system. Hence, for most applications the preferred embodiment is a three link (in the interconnecting linkage set) arrangement unless specific requirements require otherwise.

For the varying permitted relative orientations/geometries between the accessory body portion and primary support portion to be allowed by the linkage connecting set, the links must have connection comprising joints allowing angular movement at either, but preferably both, ends of each. While bush type joints can be used, the full range of typical geometries generally require a pivotable joint. The typical degree of angular freedom of these joints are at least 6° and typically substantially 8°. Greater degrees of freedom (e.g. 12° or more) can be considered though are typically larger and of greater cost. In preferred embodiments 8° freedoms are employed when the typically range of geometries in use are around 6° or less—this helps avoid situations where angles in practice exceed the ratings of the joint. Various pivoting joints may be employed, including what are often referred to as ball joints. These may be integrally part of the link, or attachable thereto such as (for example) by a threaded connection. These joints, commonly used in vehicle suspension systems among other things, typically have a bearing inside which allows smoother movement. As embodiments of the present invention are typically used out of doors in the presence of particulate materials such as sand and rock fines, joints with shields or means to limit the ingress of foreign material into the joint are generally preferred.

The arrangement of the links can be varied, though as mentioned previously the mounting points are typically such that the links are, and remain, substantially parallel to each other though this is perhaps less important for three link arrangements. However in preferred embodiments substantially parallel link arrangements are typically preferred.

Taking three link embodiments as an example, the generally preference is for two of the links to be close to the bottom edge of the accessory body portion, mainly for the reason that this is where an accessory experiences the greatest load—i.e. where it meets the ground or working face. The third link is positioned above these links and typically near the top of the accessory body portion. Its primary purpose is to restrict/limit pitching of an accessory. Placing this link as far as possible above the lower links is generally preferred as this places it further from the pivot point created by the two lower connections (imagine a pivot line connecting the two lower joints). The same general consideration are typically also applicable to four link embodiments, and others.

Viewing the invention from the front, placing the links of the interconnecting linkage set outwardly of the centre helps provide more stability and resistance to loads forcing the accessory/body portion about a vertical rotational axis. Spreading them apart, particularly in the vicinity of greatest typical working load—near the bottom of the accessory body portion—helps distribute and accommodate loads. In a three link system, where the upper link is primarily involved in resisting changes in pitch, placing this centrally is generally the preferred option. In practice, geometries may be varied slightly and particularly if to avoid other components of the invention or interference therebetween during operation of the invention.

Thus far we have described an invention comprising a primary support portion and accessory body portion with links allowing and limiting a range of relative geometries/orientations of the one to the other. In practical embodiments there is also an operational control linkage set, which shall now be discussed.

For controlling and setting the relative geometric disposition of the primary support portion and accessory body portion to each other there is provided an operational control linkage set. Of this set at least one link needs to be a variable (during operation of the invention) length link such as an actuator or something functionally equivalent. Preferably, for most embodiments, there will be at least two variable links. They may operate in different manners though hydraulic power is the most commonly used power and control method on vehicles to which the invention is likely to be fitted.

Probably it is best to refer to FIGS. 1 through 5 herein when talking about the variable links of the operational control linkage set, and in which (6*a*) and (6*b*) are the variable link actuators. Through their operation the accessory body portion (assuming the primary support portion is in a fixed reference position) can be elevated/lowered (both actuators (6*a,b*) retracted or extended by the same amount) as well as in a roll movement where the accessory body portion rotates about a longitudinal axis extending away from an imaginary vehicle the invention is attached to. By judicious control of each, whether manually by an operator or by a control system, the accessory body portion can be put into various permitted geometric positions allowed by the interconnecting linkage set. As for the links in that set, the variable links also have joints at either or (preferably) both ends allowing relative angular movement. Ball or similar pivot joints are again generally preferred over bushes, especially where lateral movement is permitted (see below).

It is important to note that the operational control linkage set does not control or restrict relative lateral movement of the accessory body portion relative to the primary support portion—this is the domain of the lateral linkage(s). However (depending on the joints used for connections) they do not restrict relative lateral movement, though such limits could be factored into the joint connection type (e.g. rotating joint instead of ball joint).

There is not too much more to say about the operational control linkage set, other than that their operation on a three link embodiment is quite well illustrated in FIGS. 1 to 5, and that of a four link system in FIGS. 6 through 11. In an alternative three link embodiment with yaw control for the accessory body portion (FIGS. 12 through 15) the variable actuators (6*a*, 6*b*) can be seen. In most cases off the shelf actuators, typically hydraulic, are employed.

Preferred embodiments of the invention also include a lateral linkage set comprising at least one link which directly or indirectly connects the primary support and accessory body portions. Where lateral side shift of the accessory body portion relative to the primary support portion then this link may be fixed. By using a fixed length link then relative lateral movement is prevented. However most embodiments use a variable (during operation) length link such as an actuator, which allows the relative lateral disposition of the primary support and accessory body portions to be controllably varied. In FIGS. 1 through 5 this is actuator (8) and ideally is oriented (when viewed from above) to be substantially parallel to the transverse axis of the invention.

More than one such variable link may be provided and the alternative embodiment of FIGS. 12 through 15 a pair of actuators (140*a, b*) are provided to effect relative lateral movement. As appreciated various fixed and variable link arrangements can be employed to effect and/or limit relative lateral disposition of the primary support and accessory body portions.

Lateral travel of the accessory relative to the operating vehicle potentially enhances the usefulness of the present invention over much of the prior art. Side shifting an accessory to bring it close to a feature near the vehicle, such as kerbs, building edges etc. can give a degree of additional fine control to an operator. Additionally it allows an operator to deal with ridges of aggregate material which might otherwise fall within the path of a vehicle's wheel—lateral shifting allowing clearance of material in the vicinity of the vehicles path/track. There are a number of situations which commonly arise for which side shifting apparatus can provide a potential advantage.

While side shifting apparatus is known, most are relatively complex in nature, or require a degree of precision in their manufacture (which adds to fabrication costs). Reliability and durability are other considerations, and any design which improves on these are of potential advantage and benefit to the art and users of such equipment.

Also, operator simplicity is also considered an advantage in the art. The less separate or independent actuators (in a manual system) that an operator has to focus on controlling, the more time they can spend on providing a quality result. Similarly, the less actuators for a controller (such as for a guidance control system, or operator assisted arrangement) to deal with, the less computing power required and less possible interactions (e.g. cross-talk issues which can be near impossible to resolve) which can arise between actuators. Reducing the number of actuators to reduce these latter complication is of significant benefit to the industry, and can provide apparatus capable of finer control and better quality results—not to mention capable of greater responsiveness and hence vehicle travel speed during operation. Hence improvements which address these issues are both useful and wanted.

In further embodiments, particular when a grading type operation (similar to conventional graders) is required there is a desirability to provide for rotational movement of the accessory about a vertical z-axis—which in aviation terms would be a yaw movement.

Such embodiments further include a yaw controlling linkage set comprising at least one variable (during operation) controllable link—such as, for instance, an actuator. Preferably two are provided for stability and to meet typical loading demands. Where two are provided these more often either side of the sagittal plane (vertical plane on which the invention's longitudinal axis lies). This can be better seen in the embodiment illustrated in FIGS. 12 through 15 by way of example. They need not be symmetrically distributed though this is the preference. Other arrangements are also possible.

Referring to FIGS. 12 through 15, if link (4*b*) is variable (during operation) in length then operation of the yaw controlling linkage set (typically in unison) in conjunction therewith can be used to alter the pitch of the accessory body portion and thus accessory. This may not always be required and such additional features do increase the complexity of the resulting equipment. However, for excavator mounting such additional flexibility can be of advantage as it can offset some of the limitations of excavator mounting—the end of an excavator arm does not provide the same stable platform as wheeled/tracked vehicles where the angle of the primary support portion is largely determined by the angle of the ground. In contrast excavator arms have an increased range of movements affecting anything mounted to the arm.

Within the realm of the present invention there is a realm of different possible embodiments, according to user choice. The following non-limiting overview of possible options is for illustrative purposes only to provide some further insight to the rest of the description herein.

According to one aspect of the present invention there is provided a ground/face working assembly comprising a primary support portion and an accessory body portion;

said primary support portion and accessory body portion being connected by an interconnecting linkage set;

said accessory body portion including and/or allowing for attachment of an accessory thereto;

there being included an operational control linkage set for affecting the relative positional disposition between said primary support portion and said accessory body portion.

According to another aspect of the present invention there is provided a ground/face working assembly, substantially as described above, in which said interconnecting linkage set comprises position limiting linkages comprising one or more of: fixed length linkages, manually adjustable length linkages, powered adjustable length linkages, and actuators.

According to another aspect of the present invention there is provided a ground/face working assembly, substantially as described above, in which one or more said position limiting linkages of said interconnecting linkage set is attached at at least one of its ends by a movement accommodating connection.

According to another aspect of the present invention there is provided a ground/face working assembly, substantially as described above, where a movement accommodating connection allows for angular movement of the length of a position limiting linkage relative to a portion it is attached to.

According to another aspect of the present invention there is provided a ground/face working assembly, substantially as described above, wherein permitted angular movement is substantially within 2 dimensions or a plane.

According to another aspect of the present invention there is provided a ground/face working assembly, substantially as described above, wherein permitted angular movement is substantially within 3 dimensions.

According to another aspect of the present invention there is provided a ground/face working assembly, substantially as described above, in which one or more said position limiting linkages of said interconnecting linkage set is attached at at least one of its ends by one or more of the following means: a pivotable connection, a self-centring flexible connection, a connection allowing limited movement from an axis, a flexible or compressible bush type arrangement.

According to another aspect of the present invention there is provided a ground/face working assembly, substantially as described above, in which said interconnecting linkage set comprises a set of three position limiting linkages.

According to another aspect of the present invention there is provided a ground/face working assembly, substantially as described above, in which said three position limiting linkages are connected to either or both the primary support portion and accessory support portion in a triangular arrangement.

According to another aspect of the present invention there is provided a ground/face working assembly, substantially as described above, in which said triangular arrangement is substantially an isosceles triangle arrangement.

According to another aspect of the present invention there is provided a ground/face working assembly, substantially as described above, in which said triangular arrangement is such that there is a least one substantially centrally located connection point, and two outboard, one on either side thereof.

According to another aspect of the present invention there is provided a ground/face working assembly, substantially as described above, in which the longitudinal axes of said position limiting linkages are substantially parallel, or within 15° of parallel, relative to each other.

According to another aspect of the present invention there is provided a ground/face working assembly, substantially as described above, in which said interconnecting linkage set comprises a set of four position limiting linkages.

According to another aspect of the present invention there is provided a ground/face working assembly, substantially as described above, in which said four position limiting linkages are connected to one of the primary support portion or accessory support portion in a triangular arrangement, such that the connection of two of the four linkages are adjacent and/or close to each other.

According to another aspect of the present invention there is provided a ground/face working assembly, substantially as described above, in which said adjacent and/or close connection point is near the middle of the portion it is on, when viewed in plan.

According to another aspect of the present invention there is provided a ground/face working assembly, substantially as described above, in which said triangular arrangement is substantially as isosceles triangle arrangement.

According to another aspect of the present invention there is provided a ground/face working assembly, substantially as described above, in which said interconnecting linkage set comprises a set of four position limiting linkages.

According to another aspect of the present invention there is provided a ground/face working assembly, substantially as described above, in which said four position limiting linkages are connected to either or both the primary support portion and accessory support portion in an arrangement comprising one or more of: a rectangle, a parallelogram, a rhombus, and an irregular polygon.

According to another aspect of the present invention there is provided a ground/face working assembly, substantially as described above, in which said position limiting linkages are arranged in two pairs.

According to another aspect of the present invention there is provided a ground/face working assembly, substantially as described above, in which position limiting linkages of a pair are disposed that one is higher than the other when viewed from the side.

According to another aspect of the present invention there is provided a ground/face working assembly, substantially as described above, which position limiting linkages of a pair are substantially parallel, or within 15° of parallel, relative to each other According to another aspect of the present invention there is provided a ground/face working assembly, substantially as described above, in which the arrangement of said pairs of position limiting linkages are such that they are a mirror image of each other about a sagittal (longitudinal) or parasagittal plane.

According to another aspect of the present invention there is provided a ground/face working assembly, substantially as described above, in which the longitudinal axes of said position limiting linkages in a pair are substantially parallel, or within 30° of parallel, relative to each other.

According to another aspect of the present invention there is provided a ground/face working assembly, substantially as described above, in which the longitudinal axes of position limiting linkages between two corresponding interconnecting linkages, one in each said pair, when viewed in plan are substantially parallel, or within 30° of parallel, relative to each other.

According to another aspect of the present invention there is provided a ground/face working assembly, substantially as described above, where said position-limiting linkages of a said interconnecting linkage set are distanced laterally from each other when viewed in plan view According to another aspect of the present invention there is provided a ground/face working assembly, substantially as described above, where at least one of said position-limiting linkages of the linkage set are distanced vertically relative to another when viewed in end elevation view.

According to another aspect of the present invention there is provided a ground/face working assembly, substantially as described above, in which the arrangement of position-limiting linkages of the linkage set are arranged such that raising and lowering of the elevation of the accessory body portion relative to the primary support portion is allowed.

According to another aspect of the present invention there is provided a ground/face working assembly, substantially as described above, in which the arrangement of position-limiting linkages of the linkage set are arranged such that during permitted relative elevation changes between said accessory body portion and the primary body portion, any change (alteration) of the coronal planes (of each of said accessory body portion and said primary body portion) relative to each other during elevation changes is less than 15°.

According to another aspect of the present invention there is provided a ground/face working assembly, substantially as described above, in which the arrangement of position-limiting linkages of the linkage set are arranged such that during permitted relative elevation changes between said accessory body portion and the primary body portion, any change (alteration) of the coronal planes (of each of said accessory body portion and said primary body portion) relative to each other during elevation changes is less than 7.5°.

According to another aspect of the present invention there is provided a ground/face working assembly, substantially as described above, in which the operational control linkage set comprises at least an elevation control linkage set, said elevation control linkage set comprising at least one elevation controllable linkage connecting between points on said primary support portion and accessory body portion.

According to another aspect of the present invention there is provided a ground/face working assembly, substantially as described above, in which said elevation control linkage set comprises a plurality of elevation controllable linkages.

According to another aspect of the present invention there is provided a ground/face working assembly, substantially as described above, in which there is at least one elevation controllable linkage positioned either side of the sagittal (median) plane of either or both of the primary support portion and accessory body portion.

According to another aspect of the present invention there is provided a ground/face working assembly, substantially as described above, in which at least one said elevation controllable linkage is oriented such to be, when viewed in plan, substantially parallel or within 15° thereof a position limiting linkage of said interconnecting linkage set.

According to another aspect of the present invention there is provided a ground/face working assembly, substantially as described above, in which at least one said elevation controllable linkage is oriented, such that when the median (sagittal) planes of the primary support portion and accessory body portion are substantially aligned or near to each other, to lie substantially within a sagittal or parasagittal plane or within 15° thereof.

According to another aspect of the present invention there is provided a ground/face working assembly, substantially as described above, in which there is a pair of elevation controllable linkages in the control linkage set, set outboard and one either side of the medial (sagittal) plane of the ground/face working assembly.

According to another aspect of the present invention there is provided a ground/face working assembly, substantially as described above, in which said pair of elevation controllable linkages are, when viewed in plan, substantially parallel to each other or within 30° thereof.

According to another aspect of the present invention there is provided a ground/face working assembly, substantially as described above, in which an elevation controllable linkage comprises an actuator.

According to another aspect of the present invention there is provided a ground/face working assembly, substantially as described above, in which an elevation controllable linkage comprising an actuator is at least one of the set comprising: hydraulically powered, pneumatically powered, electromagnetically powered, and electrically powered.

According to another aspect of the present invention there is provided a ground/face working assembly, substantially as described above, in which the operational control linkage set comprises at least a lateral control linkage set, said lateral control linkage set comprising at least one lateral controllable linkage connecting between points on said primary support portion and accessory body portion.

According to another aspect of the present invention there is provided a ground/face working assembly, substantially as described above, in which said lateral control linkage set comprises a transversely disposed controllable linkage which is connected to a point on the primary support portion at one side of the sagittal (median) plane thereof, and at its distal end to a point on the alternate side of the sagittal (median) plane of the accessory body portion.

According to another aspect of the present invention there is provided a ground/face working assembly, substantially as described above, in which said transversely disposed controllable linkage is attached to a rearwardly or forwardly extending portion of either or both of the primary support portion and accessory body portion, such that said transversely disposed controllable linkage is, when viewed in plan, substantially parallel to the coronal plane of the ground/face working assembly or within 30° thereof.

According to another aspect of the present invention there is provided a ground/face working assembly, substantially as described above, in which said lateral control linkage set comprises a plurality of lateral controllable linkages.

According to another aspect of the present invention there is provided a ground/face working assembly, substantially as described above, in which there is at least one lateral controllable linkage positioned either side of the sagittal (median) plane of either or both of the primary support portion and accessory body portion.

According to another aspect of the present invention there is provided a ground/face working assembly, substantially as described above, in which, when there is a lateral controllable linkage either side of the sagittal (median) plane, the ends connecting to the primary support portion connect to a point at, near, or adjacent the median (sagittal) plane.

According to another aspect of the present invention there is provided a ground/face working assembly, substantially as described above, in which, when there is a lateral controllable linkage either side of the sagittal (median) plane, the ends connecting to the accessory body portion connect to a point at, near, or adjacent the median (sagittal) plane.

According to another aspect of the present invention there is provided a ground/face working assembly, substantially as described above, in which where there are two lateral controllable linkages, the connection points to either the primary support portion or accessory body portion are at, near, or adjacent each other.

According to another aspect of the present invention there is provided a ground/face working assembly, substantially as described above, in which where there are two lateral controllable linkages, the connection points to either the primary support portion or accessory body portion are at, near, or adjacent each other when viewed in plan.

According to another aspect of the present invention there is provided a ground/face working assembly, substantially as described above, in which there is a pair of lateral controllable linkages in the control linkage set, set outboard and one either side of the medial (sagittal) plane of the ground/face working assembly whose longitudinal axes, when viewed in plan, are at an obtuse angle to each other.

According to another aspect of the present invention there is provided a ground/face working assembly, substantially as described above, in which a lateral controllable linkage comprises an actuator.

According to another aspect of the present invention there is provided a ground/face working assembly, substantially as described above, in which a lateral controllable linkage comprising an actuator is at least one of the set comprising: hydraulically powered, pneumatically powered, electromagnetically powered, and electrically powered.

According to another aspect of the present invention there is provided a ground/face working assembly, substantially as described above, wherein said primary support portion is adapted to allow attachment thereof to a supporting vehicle;

According to another aspect of the present invention there is provided a ground/face working assembly, substantially as described above, wherein said primary support portion includes a proprietary or other connection arrangement allowing for the relative quick connection of the primary support portion to a vehicle.

According to another aspect of the present invention there is provided a ground/face working assembly, substantially as described above, in which a vehicle comprises one or more of: a skid-steer vehicle, a tractor, an excavator, a vehicle running on rails, a floating vessel, a barge, a ship, a boat, a bulldozer, a tracked vehicle, a semi-tracked vehicle.

According to another aspect of the present invention there is provided a ground/face working assembly, substantially as described above, in which the primary support portion is in turn attached to a vehicle support portion.

According to another aspect of the present invention there is provided a ground/face working assembly, substantially as described above, in which said vehicle support portion is part of a vehicle, or a portion attachable to a vehicle.

According to another aspect of the present invention there is provided a ground/face working assembly, substantially as described above, wherein said vehicle support portion includes a proprietary or other connection arrangement allowing for the relative quick connection of the primary support portion to a vehicle.

According to another aspect of the present invention there is provided a ground/face working assembly, substantially as described above, in which the attachment between the primary support portion and vehicle support portion allows pivoting of one relative to the other.

According to another aspect of the present invention there is provided a ground/face working assembly, substantially as described above, in which said pivoting of the primary support portion relative to the vehicle support portion comprises pivoting substantially about a vertical axis or an axis within 15° thereof.

According to another aspect of the present invention there is provided a ground/face working assembly, substantially as described above, in which there is provided a yaw controlling linkage set comprising at least one controllable linkage between said primary support portion and vehicle support portion to provide and/or control relative pivoting between the two portions.

According to another aspect of the present invention there is provided a ground/face working assembly, substantially as described above, in which there are provided two controllable linkages between said primary support portion and vehicle support portion to provide and/or control relative pivoting between the two portions, arranged one controllable linkage substantially either side of a sagittal or para-sagittal plane.

According to another aspect of the present invention there is provided a ground/face working assembly, substantially as described above, in which a said controllable linkage between said primary support portion and vehicle support portion comprises an actuator.

According to another aspect of the present invention there is provided a ground/face working assembly, substantially as described above, in which a said actuator between said primary support portion and vehicle support portion is at least one of the set comprising: hydraulically powered, pneumatically powered, electromagnetically powered, and electrically powered.

According to another aspect of the present invention there is provided a ground/face working assembly, substantially as described above, wherein an accessory body portion includes and/or allows for the attachment of at least one accessory from the set comprising: a blade, a mouldboard, a double sided bladed, a rotary powered drum, a rotary powered drum with ground working features, an attachment for adjusting the elevation of a mounted accessory relative to the accessory body portion, a rake, a rotary assembly with rock or aggregate affecting teeth.

According to another aspect of the present invention there is provided a ground/face working assembly, substantially as described above, which includes a forward wheel set.

According to another aspect of the present invention there is provided a ground/face working assembly, substantially as described above, in which forward wheel set is capable of: being removed, elevated, folded.

According to another aspect of the present invention there is provided a ground/face working assembly, substantially as described above, in which there is provided a quick connection means for the attachment of a separate forward wheel set.

According to another aspect of the present invention there is provided a ground/face working assembly, substantially as described above, which includes a control system allowing a user to adjust movable components of the ground/face working assembly.

According to another aspect of the present invention there is provided a ground/face working assembly, substantially as described above, which includes one or more mounted components relating to a guidance system.

According to another aspect of the present invention there is provided a ground/face working assembly, substantially as described above, in which information from components relating to a guidance system are forwarded to a control system.

According to another aspect of the present invention there is provided a ground/face working assembly, substantially as described above, which allows semi- or fully automated control of the spatial positioning of a mounted or present accessory in response to predetermined or selected criteria.

According to another aspect of the present invention there is provided a ground/face working assembly, substantially as described above, in which the spatial positioning of a mounted or present accessory varies according to at least the position of an accessory within a designated worksite.

According to another aspect of the present invention there is provided a ground/face working assembly, substantially as described above, in which factors such as the relative and/or absolute spatial positions of an accessory and/or accessory body portion are taken into account in controlling its desired position, such factors including one or more of (but not restricted to): elevation, direction, roll inclination, pitch, yaw position, velocity.

According to another aspect of the present invention there is provided a ground/face working assembly, substantially as described above, wherein ground/face includes and is not restricted to: the ground, slopes, mining faces, cutting faces, tunnelling faces, underwater surfaces.

The nature and operation of the embodiment described above will be better described with reference to the drawings.

DESCRIPTION OF PREFERRED EMBODIMENT

Figure 1:
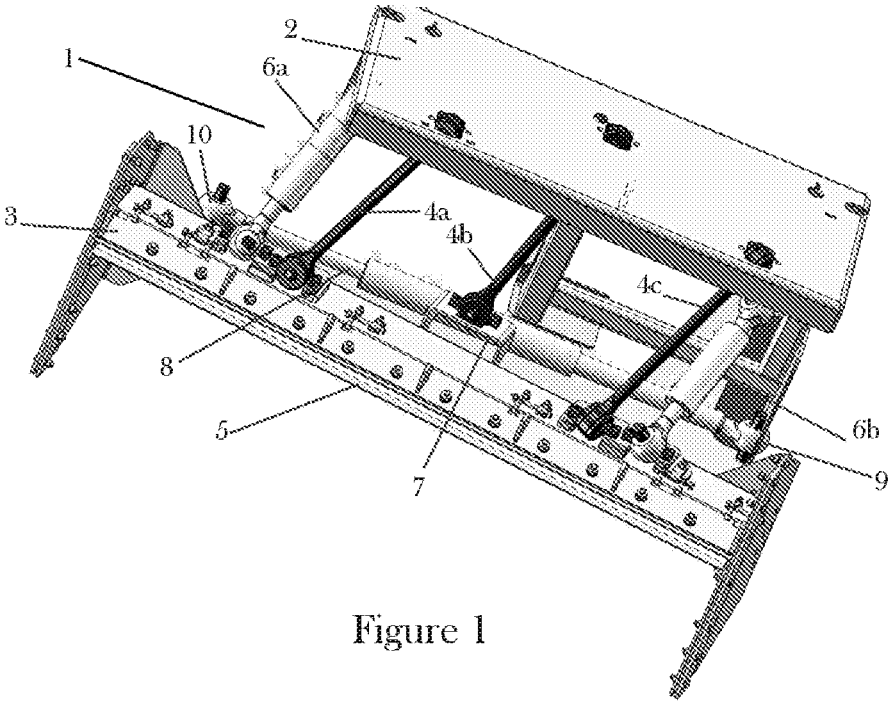
FIG. 1 is a bottom perspective view of one preferred embodiment of the present invention with a three-link position limiting arrangement.
Figure 2:
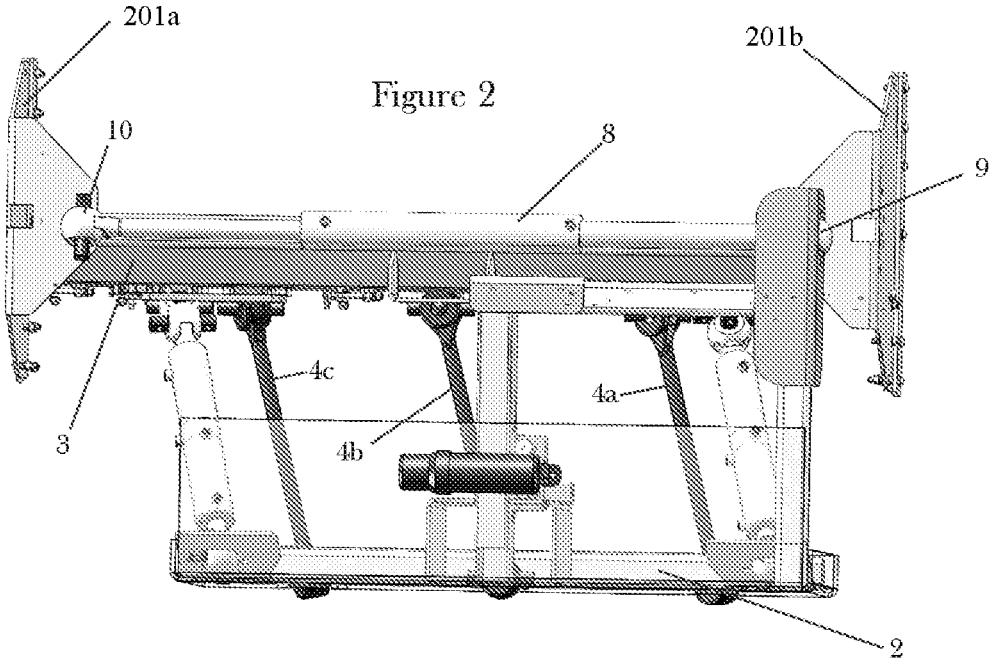
FIGS. 2-6 are varying perspective diagrammatic views of the embodiment of FIG. 1 in differing configurations FIG. 3 are front views of the embodiment of FIG. 1 with the blade in lowered, raised, and inclined (about a forward axis) respectively.
Figure 3:
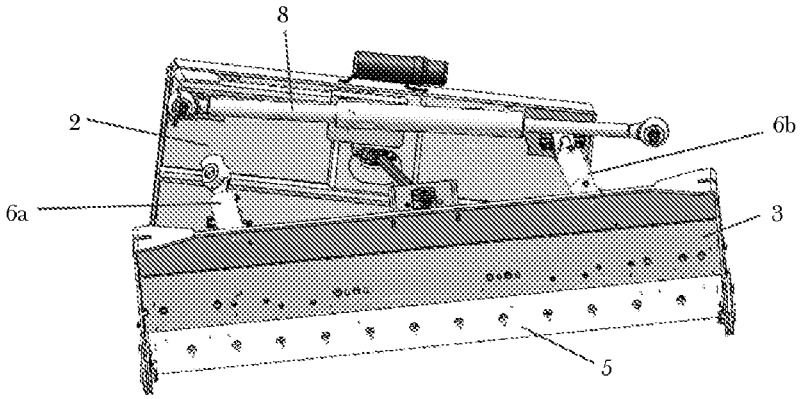
Figure 4:
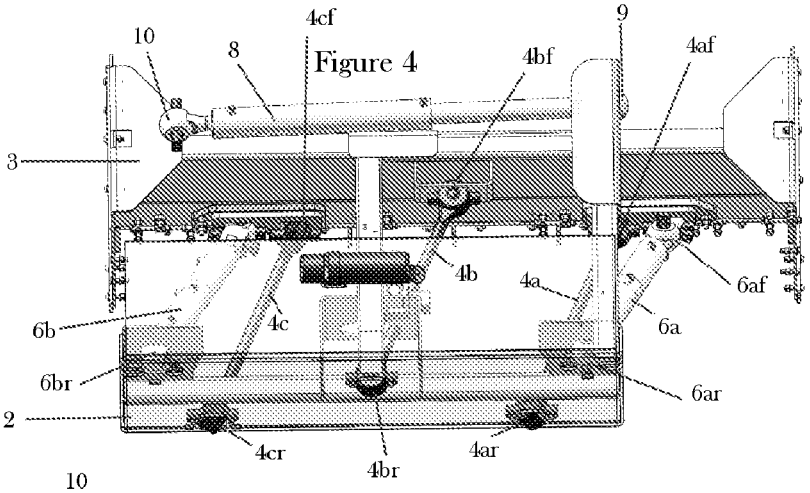
Figure 5:
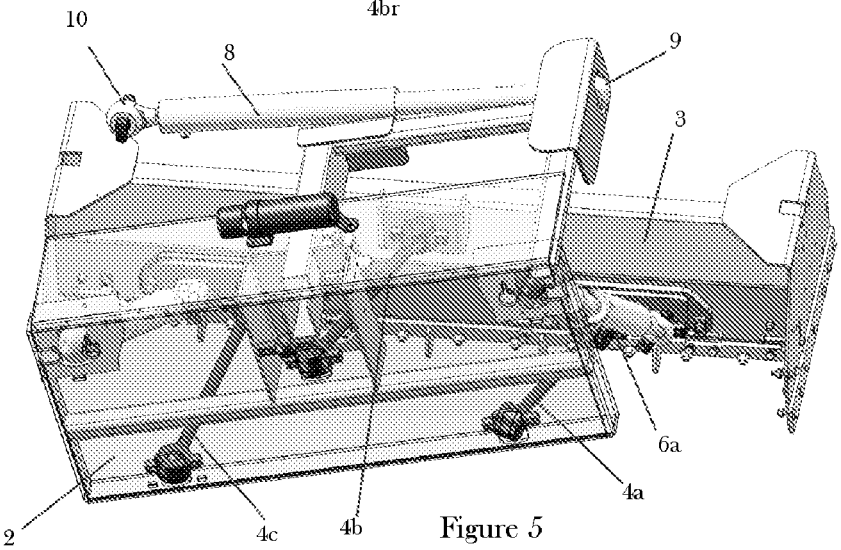
Figure 6:
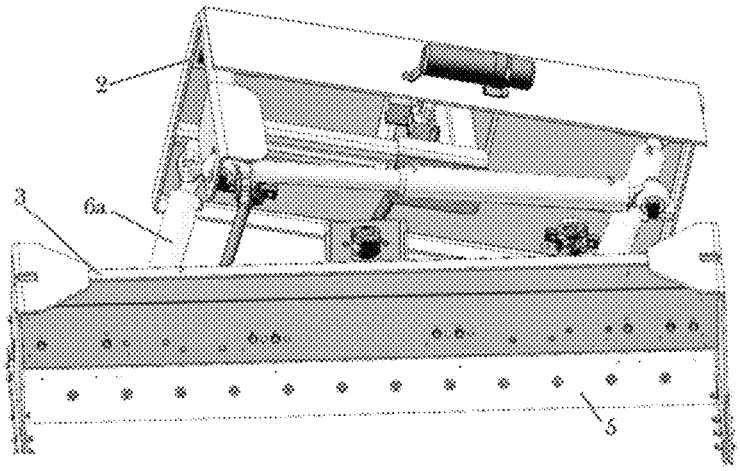
Figure 7:
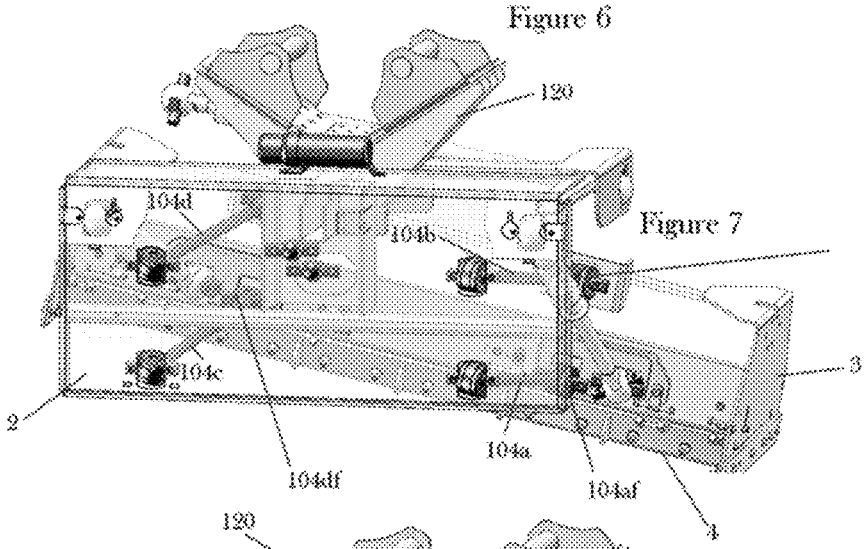
FIG. 7 is an alternate embodiment of the present invention employing a dual quadrilateral connected four-link position limiting arrangement.
Figure 8:
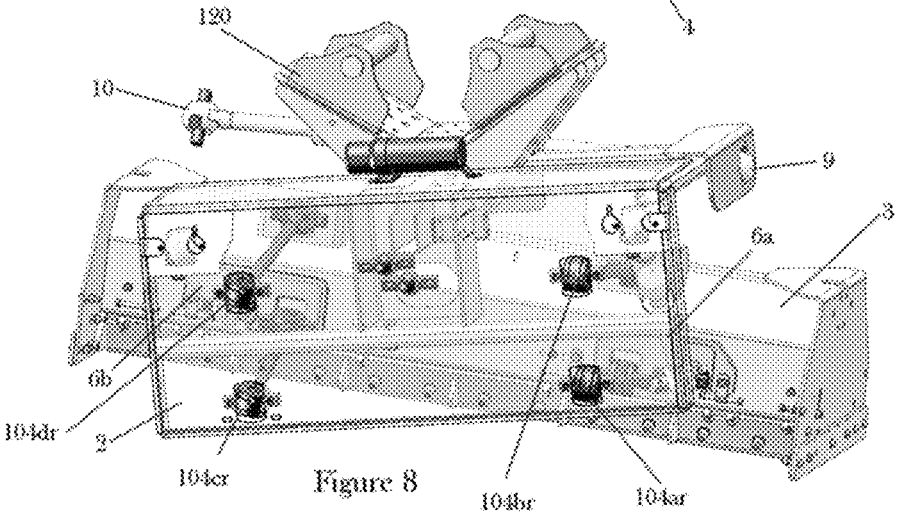
FIGS. 8-11 are varying perspective diagrammatic views of the embodiment of FIG. 7 in differing configurations.
Figure 9:
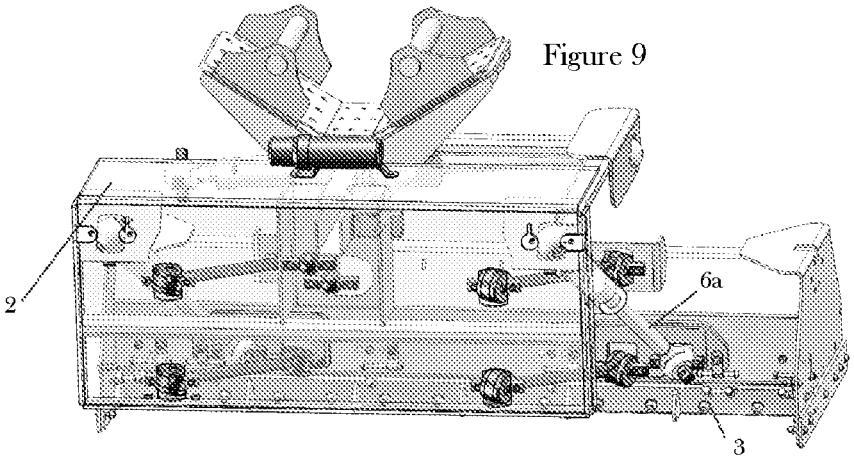
Figure 10:
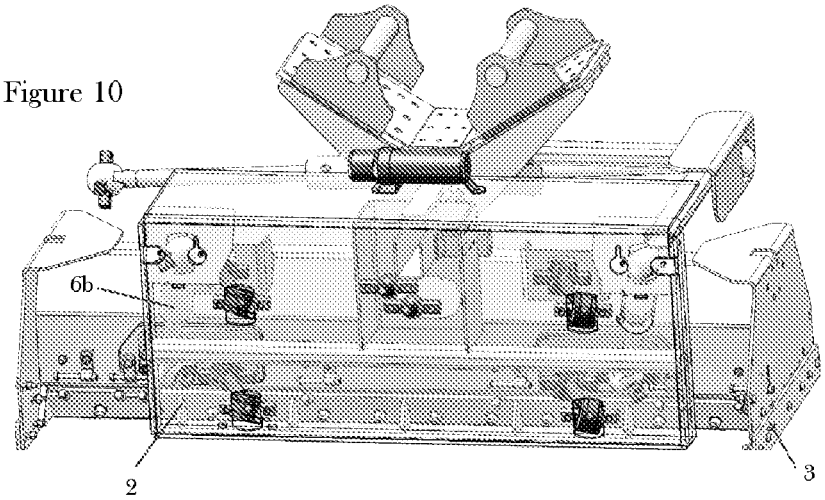
Figure 11:
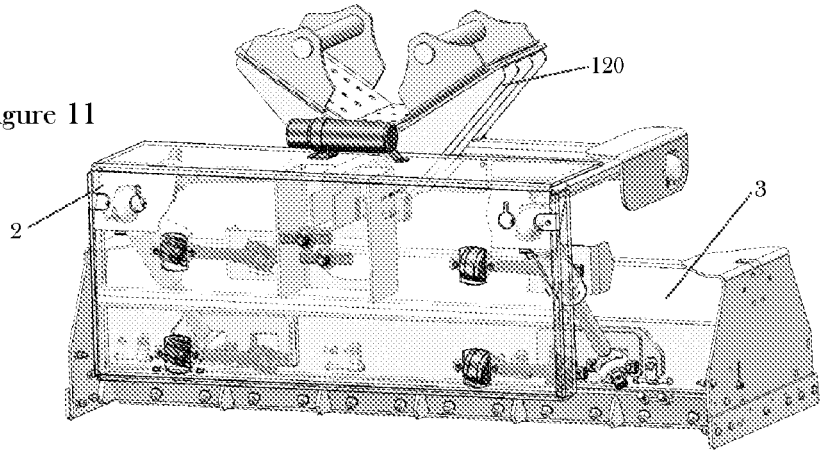
Figure 12:
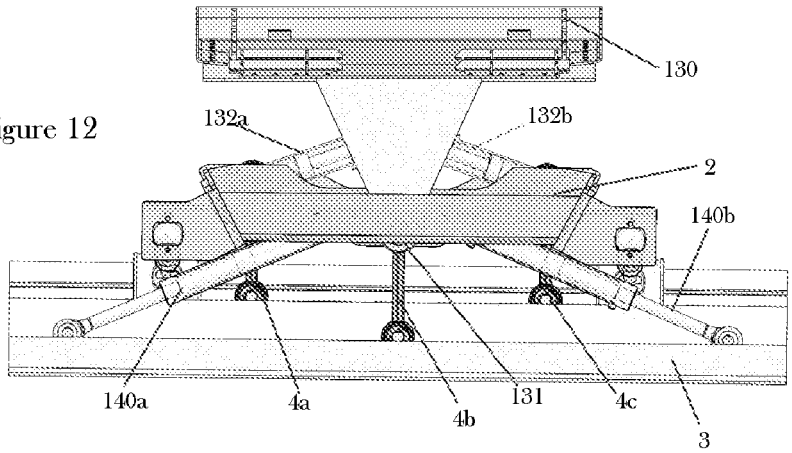
FIG. 12 is a further embodiment of the present invention with additional pivoting features suitable for grading type operations.
Figure 13:
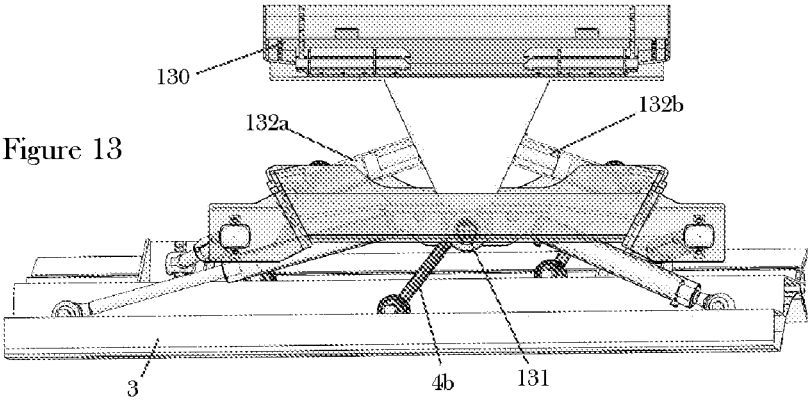
FIGS. 13-15 are varying perspective diagrammatic views of the embodiment of FIG. 12 in differing configurations
Figure 14:
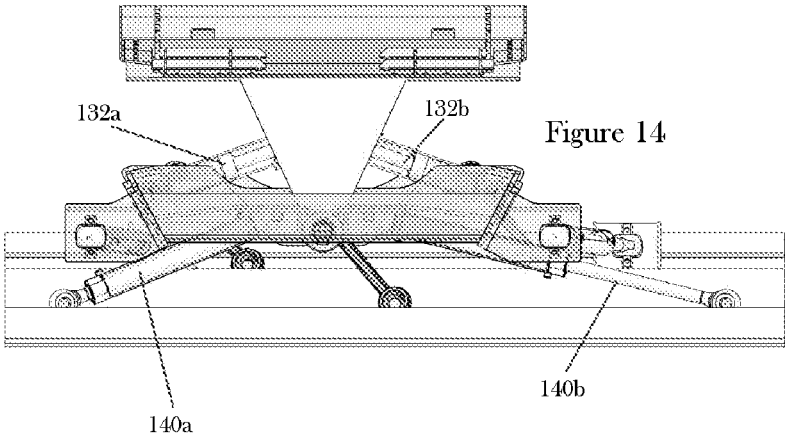
Figure 15:
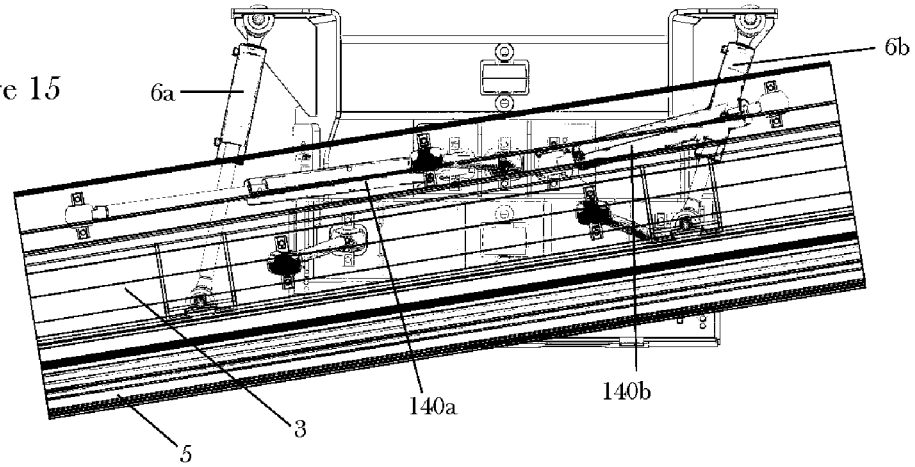

With reference to the drawings and by way of example only there is provided a ground/face working assembly (generally indicated by arrow 1) comprising a primary support portion (2) and an accessory body portion (3);

said primary support portion (2) and accessory body portion (3) being connected by an interconnecting linkage set (4*a*, 4*b*, 4*c*);

said accessory body portion including and/or allowing for attachment of an accessory (5) thereto;

there being included an operational control linkage set (6*a*, 6*b*) for affecting the relative positional disposition between said primary support portion (2) and said accessory body portion (3).

In this embodiment of the invention the accessory body portion (3) includes a fastened accessory (5), which is a blade or mouldboard. This is bolted to the main support structure of the accessory body portion (3) and can be replaced. Other accessories may be present in different embodiments, including multiple mounted accessories including rakes, power drums, etc. As an option the blade (5) can be hingedly mounted to the accessory body portion (3) so it can pivot forwardly and upwardly about a lateral transverse axis but is limited (e.g. by stops) in movement in the reverse direction. This allows the blade (5) to pivot upwardly an out of the way during reverse vehicle travel so an not to unduly disturb already levelled ground. Optionally a second reverse facing blade can be fixed to the accessory body portion and may also be hinged to deflect during forward vehicle travel. In this manner both forward and reverse levelling operations can be performed.

The interconnecting linkage set comprises, in this embodiment, three fixed length position limiting linkages (4*a-c*). These are arranged in a triangular arrangement, being an isosceles triangle with mirror symmetry through the median plane of each of the primary support portion (2) and accessory body portion (3) respectively.

In preferred embodiment position limiting linkages (4*a-c*) connect at each end with flexible or pivotable connections (4*af*, 4*ar*, 4*bf*, 4*br*, 4*cf*, 4*cr*) allowing a degree of angular movement of the longitudinal axis of the position limiting linkage relative to the connection point. In preferred embodiments ball-head type connections are employed, such as used in steering and suspension connections in the trucking and transport industry have proven to be not only suitable but extremely durable in use (as well as relatively inexpensive due to scale of availability). While bushes, also used in the same industry can be used, it is found that pivoting connections such as ball joints provide better freedom of movement and less resistance to angular movement. Typically around 8° angular movement joints are satisfactory, though if the length of the links is reduced in a particular design (to bring the accessory body portion closer to the primary support portion) then a greater degree of angular movement (e.g. 12° or higher) may be required. Ideally any ball joints should have shielding caps or features to help prevent the ingress of foreign material.

The links themselves may be fixed length or adjustable in length for during assembly. 80 kN rods are generally suitable for typical levelling and grading applications.

It should be noted that the side guards (201*a,b*) need not be provided on embodiments. These are commonly used on box levellers and stops spillage at the end for precision edging operations. However for situations involving more of a grading and spreading type operation they may be absent. The embodiment of FIGS. 12 through 15 illustrates this principle.

In other embodiments the central position limiting linkage (4*b*) can be replaced by a pair of two linkages, though one end of this pair where it attaches to either the primary support portion (2) or accessory body portion (3) should connect close to or adjacent each other (e.g. at connection mount (7)). Though in such an arrangement lateral side shift will not be possible and a better four link system is as follows.

Also provided is a four link system (four fixed length position limiting linkages) (104*a-d*) which connect to each of the primary support portion (2) and accessory body portion (3) in quadrilateral arrangements. Ideally these are symmetrically distributed either side of the sagittal plane of the apparatus, and ideally substantially parallel to each other.

However there are considerations when fabricating a four link arrangement which need to be taken into account. For instance take a situation where the accessory body portion (3) is moved sideways or vertically relative to the primary support portion (2). Here the end of each position limiting linkage moves in a mild arc if the distal end at the primary support portion is our reference and assumed fixed in space. The problem with a dual quadrilateral pattern of fixing at each end of a four link system is that moving ends of the position limiting linkages (assuming the other ends are fixed in space) move slightly out of plane. This applies stress to the plane of the accessory body portion (3) (assuming the primary support portion (2) is fixed) which has to be accommodated by the pivoting linkage connections or buckling of the plane of the accessory body portion. For mild movements (e.g. elevation as well as rotation (roll)) these may not be pronounced, but they significantly increase as the degree of, say, roll is increased). Add to this the loading on the accessory (5), and hence accessory body portion (3), during working operations then stresses and forces significantly increase. We have previously mentioned this with the three legged stool and four legged table analogy (see previously). The reality is that a high degree of precision in manufacturing and assembly is desirable to ensure the arcuate path of the joint at each link end (to the accessory body portion) is as close to identical as possible so as to avoid stresses arising from the "uneven floor" scenario.

It has been found by the inventor that applying a three point contact pattern for the position limiting linkages on either of the primary support portion (2) or accessory body portion (3) addresses these issues as a three point contact system remain in a plane regardless of the relative orientation of the body portion with which they are associated (2 or 3). Testing and development has indicated that the three position limiting connection arrangement is (currently) the optimum though further testing of physical prototypes may refine this. Consequences of these developments mean that less reinforcing and weight need be applied to body portions (2 and 3), or a greater working load/forces accommodated for a particular body design. These are significant for lighter capacity vehicles to which the ground/face working assembly is attached.

Also visible in the embodiment of FIG. 1 is an operational control linkage set comprising two elevation controllable linkages (6*a*, 6*b*), typically comprising an actuator—e.g. hydraulic. These are arranged in parallel, when viewed in plan, for this embodiment and can be used to adjust the relative elevation of each end of the accessory body portion (3) assuming the primary body portion (2) is fixed in space. This allows the elevation and roll configuration (rotation about a longitudinal axis—typically at the intersection of a parasagittal and transverse plane) of the accessory body portion (3) (relative to the primary body portion (2)) to be adjusted. Pivotable connections (6*af*, 6*ar*, 6*bf*, 6*br*) such as ball joints discussed elsewhere are preferred.

In this embodiment of the invention (FIG. 1) a further transversely disposed controllable linkage (8) comprising an actuator pivotably connects points (9) (10) on the primary body portion (2) and accessory body portion (3) respectively though the mounting bracket for pivoting joint (10) is not shown in the figures for clarity. This can be a simple bracket extending from the main body (3) of the accessory body portion. Again, pivot joints (9,10) such as discussed elsewhere are preferred.

This linkage (8) allows the accessory body portion (3) to shift sideways relative to the primary body portion (2). This effectively allows the accessory body portion to move laterally beyond the projected side plane of a vehicle to allow it to be close to existing site features (e.g. kerbs, foundation walls, etc.) for precision work. While physical limiters/stops may limit maximum lateral movement, the embodiment of FIG. 1 allows left and right transverse movement (compared to when the median (sagittal) planes of the two body portions (2 and 3) are aligned/centred. The maximum lateral transverse movement becomes largely limited by the position limiting linkages (4*a-c*) and the relative geometry adopted between the body portions (2 and 3) at the time.

A quick hitch or other commonly used connection in the industry may be provided (not shown) on the primary body portion (2), or the primary body portion may comprise same, to allow expeditious mounting of the ground/face working assembly to a vehicle or support.

FIGS. 2 through 6 show the embodiment of FIG. 1 in alternate configurations.

FIGS. 7 through 11 show a four link embodiment where the position limiting linkages (104*a-d*) connect to each of the primary support portion (2) and accessory body portion (3) in a quadrilateral arrangement of connection points. An excavator mount (120) is provided on top for connection to an excavator boom arm, though a quick hitching type system could be provided on the primary body support portion (2) as well or instead. The remaining components and construction are largely as per the embodiment of FIG. 1. The four link arrangement considerations are mentioned above, and the general nature of the four link embodiment is similar to the three link design other than the interconnecting linkage set.

FIGS. 12 through 16 show a three link embodiment, comparable to the embodiment of FIG. 1, except that the primary support portion (2) is an intermediate portion pivotably connected to a vehicle support portion (130). The pivotable connection is about a substantially vertical axis (131).

A yaw controlling linkage set comprises two variable (during operation) length operable linkages (132*a-b*) (such as actuators) between the primary support portion (2) and vehicle support portion (130) to control the degree of pivoting (yaw) of the primary support portion (2) relative to the vehicle support portion. This type of arrangement allows for the yaw-angled blade typical of graders and grading operations.

A quick connection arrangement or other means of attachment to a vehicle is typically provided on the vehicle support portion (130).

Side shifting operation is accomplished in this embodiment by two transverse operational linkages (140*a-b*) comprising actuators. These replace the transverse actuator (8) of previous embodiments.

Figure 16:
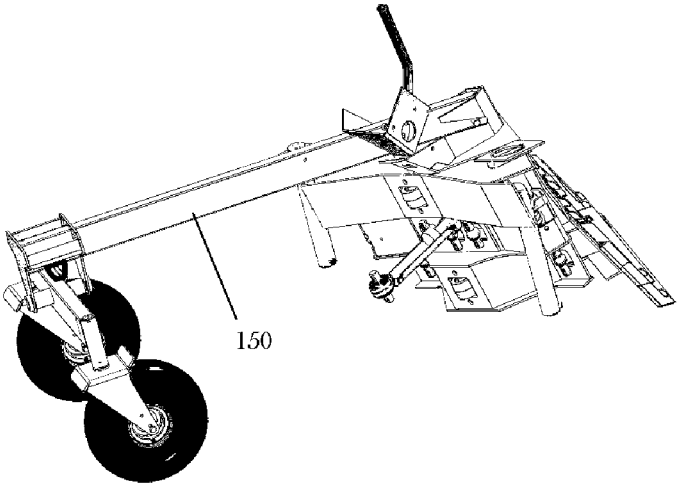
FIG. 16 is a perspective diagrammatic view of a wheel carriage arrangement suitable for use on varying embodiments of the present invention.
Figure 17:
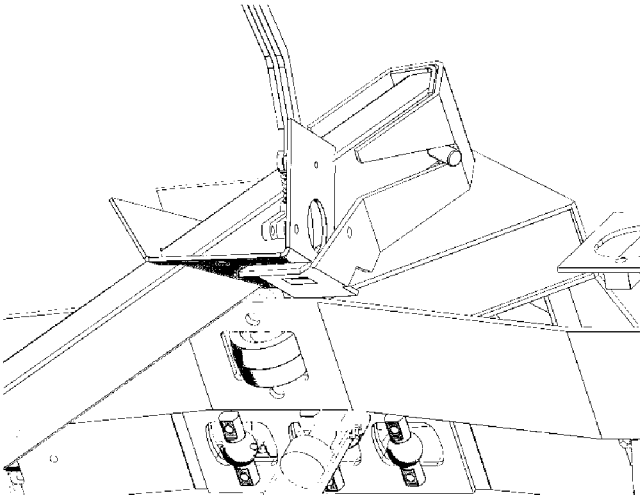
FIG. 17 is a perspective diagrammatic view of a locking connection for the carriage arrangement of FIG. 15.

In FIG. 16 we can see an optional detachable leading wheel carriage arrangement (150) which is commonly used in conjunction with levellers and can be attached or otherwise provided on the embodiments described above. FIG. 17 illustrates an optional locking mechanism for attaching and detaching it, though standard connection methods, and bolt-on techniques etc can be employed. Such carriage assemblies can be applied on various embodiments of the present invention.

Not shown, but common in the art, are sensors which attach to the accessory body portion to interact with a proprietary or common guidance system—2D, 2.5D, 3D. geospatial, laser line, etc. technologies are commonly used on worksites. The embodiments of the present invention are adaptable for such techniques and for providing information to a control or operator guidance system. They are not discussed in detail here as it is now common practice to attach or fit appropriate sensors for the guidance system that the user desires to use. Similarly hydraulic control systems to interact with such guidance systems, and can be programmed/calibrated to cause actuators to appropriately respond, are common practice in the industry.

Aspects of the present invention have been described by way of example only and it should be appreciated that modifications and additions may be made thereto without departing from the spirit or scope of the present invention as described herein.

It should also be understood that the term "comprise" where used herein is not to be considered to be used in a limiting sense. Accordingly, 'comprise' does not represent nor define an exclusive set of items, but includes the possibility of other components and items being added to the list.

This specification is also based on the understanding of the inventor regarding the prior art. The prior art description should not be regarded as being authoritative disclosure on the true state of the prior art but rather as referencing considerations brought to the mind and attention of the inventor when developing this invention.

The claims defining the invention are:

1. A ground/face working assembly comprising: a pivotable connection arrangement comprising a vehicle support portion comprising a forward extending portion, an intermediate primary support portion pivotably connected to the vehicle support portion by the forward extending portion of the vehicle support portion providing a pivotable connection allowing rotation of the intermediate primary support portion about a substantially vertical axis, and at least two controllable adjustable length links between the vehicle support portion and said intermediate primary support portion providing controllable yaw angle adjustment about said pivotable connection;

an accessory body portion connected to said intermediate primary support portion by two operable adjustable length linkages, pivotably connected to the accessory body portion at or near ends of the accessory body portion, when view in plan view; and a first fixed length linkage pivotably connected to a point at or near the pivotable connection of the vehicle support portion when viewed in plan view, a relationship between the first fixed length linkage and the two operable adjustable length linkages connected to the accessory body portion allowing sideways shifting, when viewed in plan view, of the accessory body portion relative to the vehicle support portion.

2. The ground/face working assembly as claimed in claim 1, wherein at least some of the adjustable length linkages control yaw of the intermediate primary support portion and connect to said forward extending portion of the vehicle support portion.

3. The ground/face working assembly as claimed in claim 1, further comprising two additional fixed length linkages between said intermediate primary support portion and the accessory body portion, the two additional fixed length linkages being parallel to said first fixed length linkage to the accessory body portion when viewed in plan, and at a different elevation to said first fixed length linkage when viewed from the side.

4. The ground/face working assembly as claimed in claim 1, further comprising two independently controllable roll angle adjustable length linkages disposed between said intermediate primary support portion and said accessory body portion, operation of the two independently controllable roll angle adjustable length linkages affecting a roll angle of the accessory body portion relative to the vehicle body portion when viewed from a front.

5. The ground/face working assembly as claimed in claim 1, wherein at least some of the adjustable length linkages control side-shifting movement of the accessory body portion and pivotably connect to points on the intermediate primary support portion on either side, when viewed in plan, of the substantially vertical axis about which the intermediate primary support portion pivots.

6. The ground/face working assembly as claimed in claim 1, wherein the vehicle support portion includes a quick hitch arrangement configured to attach to a vehicle.

7. The ground/face working assembly as claimed in claim 1, wherein said adjustable length linkages comprise actuators which are operable by any one of: hydraulics, electrically, and pneumatically.

8. The ground/face working assembly as claimed in claim 1, wherein the accessory body portion includes an accessory comprising a blade.

9. The ground/face working assembly as claimed in claim 1, wherein the ground/face working assembly is configured to be mounted on a vehicle.

* * * * *